US009949507B2

(12) United States Patent
Flick

(10) Patent No.: US 9,949,507 B2
(45) Date of Patent: Apr. 24, 2018

(54) AEROSOL GENERATING SYSTEM WITH IMPROVED AEROSOL PRODUCTION

(71) Applicant: Philip Morris Products S.A., Neuchatel (CH)

(72) Inventor: Jean-Marc Flick, Pomy (CH)

(73) Assignee: Philip Morris Products S.A., Neuchatel (CH)

( * ) Notice: Subject to any disclaimer, the term of this patent is extended or adjusted under 35 U.S.C. 154(b) by 996 days.

(21) Appl. No.: 14/354,349

(22) PCT Filed: Oct. 25, 2012

(86) PCT No.: PCT/EP2012/071165

§ 371 (c)(1),
(2) Date: Apr. 25, 2014

(87) PCT Pub. No.: WO2013/060781

PCT Pub. Date: May 2, 2013

(65) Prior Publication Data

US 2014/0299141 A1 Oct. 9, 2014

(30) Foreign Application Priority Data

Oct. 27, 2011 (EP) ..... 11250875

(51) Int. Cl.
*A24F 47/00* (2006.01)
*H05B 1/02* (2006.01)

(52) U.S. Cl.
CPC ..... *A24F 47/008* (2013.01); *H05B 1/0202* (2013.01)

(58) Field of Classification Search
None
See application file for complete search history.

(56) References Cited

U.S. PATENT DOCUMENTS 6,095,153 A 8/2000 Kessler et al.
6,272,933 B1 8/2001 Gradon et al.
(Continued)

FOREIGN PATENT DOCUMENTS

CN 1210020 A 3/1999
CN 102014677 A 4/2011
(Continued)

OTHER PUBLICATIONS

Office Action dated Sep. 30, 2015 in Chinese Patent Application No. 201280052497.0 (submitting English translation only).
(Continued)

*Primary Examiner* — Michael J Felton
(74) *Attorney, Agent, or Firm* — Oblon, McClelland, Maier & Neustadt, L.L.P.

(57) ABSTRACT

There is provided a method of controlling aerosol production in an aerosol-generating device, the device including an aerosol-forming substrate, a heater including at least one heating element for heating the aerosol-forming substrate, and a power source for providing power to the heating element, the method including determining the temperature of the heating element; and adjusting the power to the heating element to maintain the temperature of the heating element within a desired temperature range, wherein the desired temperature range is dynamically calculated based on a measured flow rate of gas through or past the device. By controlling the temperature of the heating element, an aerosol with consistent and desirable properties can be produced.

7 Claims, 3 Drawing Sheets

(56) References Cited

U.S. PATENT DOCUMENTS

| | | | |
|---|---|---|---|
| 6,349,722 | B1 | 2/2002 | Gradon et al. |
| 6,694,974 | B1 | 2/2004 | Gradon et al. |
| RE39,724 | E | 7/2007 | Gradon et al. |
| RE40,806 | E | 6/2009 | Gradon et al. |
| 2002/0129815 | A1 | 9/2002 | McPhee |
| 2002/0139367 | A1 | 10/2002 | McPhee |
| 2004/0060558 | A1 | 4/2004 | Gradon et al. |
| 2004/0079370 | A1 | 4/2004 | Gradon et al. |
| 2007/0045288 | A1 | 3/2007 | Nelson |
| 2007/0125765 | A1 | 6/2007 | Nelson |
| 2008/0092912 | A1 | 4/2008 | Robinson et al. |
| 2008/0257367 | A1 | 10/2008 | Paterno et al. |
| 2009/0272379 | A1 | 11/2009 | Thorens et al. |

FOREIGN PATENT DOCUMENTS

| | | | |
|---|---|---|---|
| EP | 2 110 033 | | 10/2009 |
| EP | 2 113 178 | | 11/2009 |
| JP | 2001-502542 | A | 2/2001 |
| JP | 2005-034021 | A | 2/2005 |
| JP | 2006-524494 | A | 11/2006 |
| JP | 2010-506594 | A | 3/2010 |
| JP | 2011-515093 | A | 5/2011 |
| RU | 72 821 | U1 | 5/2008 |
| WO | WO 2006/028843 | A2 | 3/2006 |
| WO | WO 2009/132793 | A1 | 11/2009 |

OTHER PUBLICATIONS

Office Action dated Aug. 8, 2016 in Japanese Patent Application No. 2014-537615 (submitting English translation only).

Office Action dated Aug. 8, 2016 in Taiwanese Patent Application No. 101139462 (submitting English translation only).

Office Action dated Aug. 11, 2016 in GCC Patent Application No. GC 2012-22826 (submitting English translation only).

International Search Report dated Feb. 27, 2013, in PCT/EP12/071165, filed Oct. 25, 2012.

Written Opinion of the International Searching Authority dated Apr. 2005 in PCT/EP12/071165 filed Oct. 25, 2012.

Russian Federation Office Action dated Dec. 15, 2016 in Patent Application No. 2014121213/12(034178) (submitting English translation only).

Extended European Search Report dated Mar. 23, 2012 in Patent Application No. 11250875.9.

International Preliminary Report on Patentability and Written Opinion dated Apr. 29, 2014 in PCT/EP2012/071165.

Office Action dated Jun. 2, 2017 in Chinese Patent Application No. 201260052497.0 (submitting English translation only).

AEROSOL GENERATING SYSTEM WITH IMPROVED AEROSOL PRODUCTION

CROSS REFERENCE TO RELATED APPLICATION

This application is a national phase application based on PCT/EP2012/071165, filed on Oct. 25, 2012.

The present invention relates to a method for controlling aerosol production. The present invention further relates to an aerosol generating system and more specifically to an electrically operated aerosol generation system. The present invention finds particular application as a method for controlling aerosol production in an aerosol generation system through at least one electric element of an electrically operated smoking system.

WO-A-2009/132793 discloses an electrically heated smoking system. A liquid is stored in a liquid storage portion, and a capillary wick has a first end which extends into the liquid storage portion for contact with the liquid therein, and a second end which extends out of the liquid storage portion. A heating element heats the second end of the capillary wick. The heating element is in the form of a spirally wound electric heating element in electrical connection with a power supply, and surrounding the second end of the capillary wick. In use, the heating element may be activated by the user to switch on the power supply. Suction on a mouthpiece by the user causes air to be drawn into the electrically heated smoking system over the capillary wick and heating element and subsequently into the mouth of the user.

It is an objective of the present invention to provide an improved method of controlling the amount of power provided to the electric heating element of such an electrically heated aerosol generating system.

One particular difficulty with an aerosol generating device is generating an aerosol with consistent properties in spite of variations in the flow rate through the device. For example, in a device in which air flow rate is generated by user inhalations, variations in the flow rate through the device can occur during the course of a single inhalation by a user or from one inhalation to the next.

It would be beneficial to generate an aerosol with the same droplet size and density, on a consistent basis, regardless of variations in air flow rate of a gas, such as air, through the device.

According to one aspect of the invention, there is provided a method of controlling aerosol production in an aerosol-generating device, the device comprising:

a heater comprising at least one heating element; and a power source for providing power to the heating element, comprising the steps of:

determining the temperature of the heating element; and adjusting the power to the heating element to maintain the temperature of the heating element within a desired temperature range, wherein the desired temperature range is dynamically calculated based on a measured flow rate of gas through or past the device.

Preferably, the device is configured to allow the air flow to be generated by a user inhalation. The device may also be an electrically heated smoking system.

An aerosol is a suspension of solid particles or liquid droplets in a gas, such as air. When aerosol is produced using a heating element to vaporise a substrate, the rate of aerosol production and the properties of the produced aerosol are dependent on the temperature of the heating element. The temperature of the heating element is determined not only by the power supplied to the heating element but also by environmental factors. In particular, the flow rate of gases past a heating element has a significant cooling affect on the heating element.

One example of a system in which there are variations in air flow rate is a system in which the air flow is generated by a user inhalation, such as an electrically operated smoking system. The variations in flow rate through the device can occur during the course of a single inhalation by a user and from one inhalation to the next. Different users have different inhalation behaviour, and a single user can have different inhalation behaviours at different times. The difference in inhalation behaviour could occur during a single inhalation, but also from inhalation to inhalation. So it is desirable to have a control method that compensates for different user and inhalation behaviours.

The desired temperature range of the heating element may consist of a single desired temperature. Alternatively, the temperature range of the heating element may span, for example, tens of degrees Celcius. The acceptable range of temperatures is those temperatures that allow an aerosol with the desired properties to be formed. If the temperature is too high there may be undesirable chemicals formed in the aerosol, if the temperature is too low the substrate may not be sufficiently vaporised and the droplet size within the aerosol may be too large.

The desired temperature range may be dependent on a composition of the aerosol-forming substrate. Different substrates will have different enthalpy of vaporisation and will suffer from chemical breakdown at different temperatures. Accordingly, the method may further comprise the step of determining a characteristic or identity of the aerosol-forming substrate and calculating or selecting the desired temperature range based on the characteristic or identity. For example, the step of determining a characteristic of the aerosol-forming substrate may comprise reading an indication of the identity of the aerosol-forming substrate formed in, or on a housing of, the aerosol-forming substrate. Once the identity of the substrate has been determined, the desired temperature range may then be selected from a database of temperature ranges for particular identities of aerosol-forming substrate. The indication of the identity of the aerosol-forming substrate may be, for example: a barcode or other surface indication; a characteristic of a substrate housing, such as shape or size; or may be a characteristic resistance or electrical response associated with a substrate housing.

In an electrically operated smoking system, for example, for users that take long but slow inhalations it may be desirable to have a lower heating element temperature, producing aerosol at a lower rate. This mimics to some extent the behaviour of a conventional lit-end combustible cigarette. However, the temperature of the heating element is maintained above a lower threshold level in order to ensure an aerosol with desirable properties is formed. This adjustment of the heater temperature based on flow rate of gas through or past the device can be used together with stored temperature ranges for specific substrate compositions. So adjustment of temperature based on flow rate can be made within a temperature range set by substrate composition.

Preferably, the step of adjusting the power is performed only after the heating element has reached a specific temperature within a desired temperature range. For example, the step of adjusting may start only after the temperature of the heating element has reached a mid-point of the predetermined temperature range.

Alternatively, or in addition, the step of adjusting the power may be performed only after a specific time has elapsed following detection of a flow of gas through the device that exceeds a predetermined threshold flow rate. It is desirable to heat the heating element as quickly as possible, given an available power supply. This is so that the aerosol with the desired properties is produced as soon as possible. So a maximum power may be delivered for a specific time following detection of the start of a user inhalation.

The method preferably also includes the step of cutting or reducing power to the heating element following the step of adjusting the power to maintain the temperature of the heating element. This may be done based on a predetermined time after activation of the heating element, a detected flow rate, or a calculated parameter related to flow rate. This ensures that aerosol production is stopped when a user inhalation ends.

The step of adjusting the power may comprise adjusting a frequency or a pulse width modulation of a pulsed power signal. If power is supplied to the heating element as a pulsed signal, adjusting the frequency of the pulses or the duty cycle of the pulses is an effective way to maintain the temperature of the heating element with a desired range.

The step of determining the temperature of the heating element may comprise determining an electrical resistance of the heating element. This provides a convenient and accurate indication of the temperature. Alternatively, a separate temperature sensor may be used.

According to another aspect of the invention, there is provided an electrically operated aerosol generating device, the device comprising: at least one heating element for forming an aerosol from a substrate; a power supply for supplying power to the heating element; and electric circuitry for controlling supply of power from the power supply to the at least one aerosol generating element, wherein the electric circuitry is arranged to:

determine the temperature of the heating element and adjust the power to the heating element to maintain the temperature of the heating element within a desired temperature range, wherein the desired temperature range is dynamically calculated based on a measured flow rate of gas through or past the device.

Preferably, the device is configured to allow the air flow to be generated by a user inhalation.

The desired temperature range may consist of a single desired temperature.

The device may be configured to receive an aerosol-forming substrate. The desired temperature range may be dependent on a composition of the aerosol-forming substrate. Different substrates will have different vaporisation temperatures and will suffer from chemical breakdown at different temperatures. Accordingly, the device may further comprise means for determining a characteristic or identity of the aerosol-forming substrate and calculating or selecting the desired temperature range based on the characteristic or identity. For example, the device may comprise means for reading an indication of the identity of the aerosol-forming substrate formed in or on a housing of the aerosol-forming substrate, and the desired temperature range may then be selected from a database of temperature ranges based on the identity of the aerosol-forming substrate. The indication of the identity of the aerosol-forming substrate may be, for example, a barcode or other surface indication, a characteristic of a substrate housing, such as shape or size, or a characteristic resistance or electrical response associated with a substrate housing.

The electrical circuitry may be configured to determine the temperature of the heating element based on a determination of an electrical resistance of the heating element. Alternatively, the device may include a separate temperature sensor.

The electric circuitry may comprise a microcontroller. The microcontroller may include a PID regulator for controlling the power supplied to the heating element.

Preferably, the electric circuitry is arranged to perform the method steps of the other aspects of the invention. To perform the method steps of the other aspects of the invention, the electric circuitry may be hardwired. More preferably, however, the electric circuitry is programmable to perform the method steps of the other aspects of the invention.

The heater may comprise a single heating element. Alternatively, it may be an electrical heater comprising one heating element. Alternatively, the electric heater may comprise more than one heating element, for example two, or three, or four, or five, or six or more heating elements. Alternatively, the electrical heater may comprise at least one heating element for heating the substrate. The heating element or heating elements may be arranged appropriately so as to most effectively heat the aerosol-forming substrate.

The at least one electric heating element preferably comprises an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, Constantan, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation, 1999 Broadway Suite 4300, Denver Colo. In composite materials, the electrically resistive material may optionally be embedded in, encapsulated or coated with an insulating material or vice-versa, depending on the kinetics of energy transfer and the external physicochemical properties required. The heating element may comprise a metallic etched foil insulated between two layers of an inert material. In that case, the inert material may comprise Kapton®, all-polyimide or mica foil. Kapton® is a registered trade mark of E.I. du Pont de Nemours and Company, 1007 Market Street, Wilmington, Del. 19898, United States of America.

Alternatively, the at least one electric heating element may comprise an infra-red heating element, a photonic source, or an inductive heating element.

The at least one electric heating element may take any suitable form. For example, the at least one electric heating element may take the form of a heating blade. Alternatively, the at least one electric heating element may take the form of a casing or substrate having different electro-conductive portions, or an electrically resistive metallic tube. If the aerosol-forming substrate is a liquid provided within a container, the container may incorporate a disposable heating element. Alternatively, one or more heating needles or rods that run through the centre of the aerosol-forming substrate may also be suitable. Alternatively, the at least one electric heating element may be a disk (end) heating element or a combination of a disk heating element with heating needles or rods. Alternatively, the at least one electric heating element may comprise a flexible sheet of material arranged to surround or partially surround the aerosol-forming substrate. Other alternatives include a heating wire or filament, for example a Ni—Cr, platinum, tungsten or alloy wire, or a heating plate. Optionally, the heating element may be deposited in or on a rigid carrier material.

The at least one electric heating element may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. Preferably, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy.

The heat sink or heat reservoir may be arranged such that it is directly in contact with the aerosol-forming substrate and can transfer the stored heat directly to the substrate. Alternatively, the heat stored in the heat sink or heat reservoir may be transferred to the aerosol-forming substrate by means of a heat conductor, such as a metallic tube.

The at least one heating element may heat the aerosol-forming substrate by means of conduction. The heating element may be at least partially in contact with the substrate, or the carrier on which the substrate is deposited. Alternatively, the heat from the heating element may be conducted to the substrate by means of a heat conductive element.

Alternatively, the at least one heating element may transfer heat to the incoming ambient air that is drawn through the electrically heated aerosol generating device during use, which in turn heats the aerosol-forming substrate by convection. The ambient air may be heated before passing through the aerosol-forming substrate. Alternatively, if the aerosol-forming substrate is a liquid substrate, the ambient air may be first drawn through the substrate and then heated.

The aerosol-forming substrate may be a solid aerosol-forming substrate. The aerosol-forming substrate preferably comprises a tobacco-containing material containing volatile tobacco flavour compounds which are released from the substrate upon heating. The aerosol-forming substrate may comprise a non-tobacco material. The aerosol-forming substrate may comprise tobacco-containing material and non-tobacco containing material. Preferably, the aerosol-forming substrate further comprises an aerosol former. Examples of suitable aerosol formers are glycerine and propylene glycol.

Alternatively, the aerosol-forming substrate may be a liquid aerosol-forming substrate. In one embodiment, the electrically heated aerosol generating device further comprises a liquid storage portion. Preferably, the liquid aerosol-forming substrate is stored in the liquid storage portion. In one embodiment, the electrically heated aerosol generating device further comprises a capillary wick in communication with the liquid storage portion. It is also possible for a capillary wick for holding liquid to be provided without a liquid storage portion. In that embodiment, the capillary wick may be preloaded with liquid.

Preferably, the capillary wick is arranged to be in contact with liquid in the liquid storage portion. In that case, in use, liquid is transferred from the liquid storage portion towards the at least one electric heating element by capillary action in the capillary wick. In one embodiment, the capillary wick has a first end and a second end, the first end extending into the liquid storage portion for contact with liquid therein and the at least one electric heating element being arranged to heat liquid in the second end. When the heating element is activated, the liquid at the second end of the capillary wick is vaporized by the heating element to form the supersaturated vapour. The supersaturated vapour is mixed with and carried in the airflow. During the flow, the vapour condenses to form the aerosol and the aerosol is carried towards the mouth of a user. The heating element in combination with a capillary wick may provide a fast response, because that arrangement may provide a high surface area of liquid to the heating element. Control of the heating element according to the invention may therefore depend on the structure of the capillary wick arrangement.

The liquid substrate may be absorbed into a porous carrier material, which may be made from any suitable absorbent plug or body, for example, a foamed metal or plastics material, polypropylene, terylene, nylon fibres or ceramic. The liquid substrate may be retained in the porous carrier material prior to use of the electrically heated aerosol generating device or alternatively, the liquid substrate material may be released into the porous carrier material during, or immediately prior to use. For example, the liquid substrate may be provided in a capsule. The shell of the capsule preferably melts upon heating and releases the liquid substrate into the porous carrier material. The capsule may optionally contain a solid in combination with the liquid.

If the aerosol-forming substrate is a liquid substrate, the liquid has physical properties. These include, for example, a boiling point, vapour pressure, and surface tension characteristics to make them suitable for use in the aerosol generating device. Control of the at least one electric heating element may depend upon the physical properties of the liquid substrate. The liquid preferably comprises a tobacco-containing material comprising volatile tobacco flavour compounds which are released from the liquid upon heating. Alternatively, or in addition, the liquid may comprise a non-tobacco material. The liquid may include water, solvents, ethanol, plant extracts and natural or artificial flavours. Preferably, the liquid further comprises an aerosol former. Examples of suitable aerosol formers are glycerine and propylene glycol.

An advantage of providing a liquid storage portion is that a high level of hygiene can be maintained. Using a capillary wick extending between the liquid and the electric heating element, allows the structure of the device to be relatively simple. The liquid has physical properties, including viscosity and surface tension, which allow the liquid to be transported through the capillary wick by capillary action. The liquid storage portion is preferably a container. The liquid storage portion may not be refillable. Thus, when the liquid in the liquid storage portion has been used up, the aerosol generating device is replaced. Alternatively, the liquid storage portion may be refillable. In that case, the aerosol generating device may be replaced after a certain number of refills of the liquid storage portion. Preferably, the liquid storage portion is arranged to hold liquid for a pre-determined number of puffs.

The capillary wick may have a fibrous or spongy structure. The capillary wick preferably comprises a bundle of capillaries. For example, the capillary wick may comprise a plurality of fibres or threads, or other fine bore tubes. The fibres or threads may be generally aligned in the longitudinal direction of the aerosol generating device. Alternatively, the capillary wick may comprise sponge-like or foam-like material formed into a rod shape. The rod shape may extend along the longitudinal direction of the aerosol generating device. The structure of the wick forms a plurality of small bores or tubes, through which the liquid can be transported to the electric heating element, by capillary action. The capillary wick may comprise any suitable material or combination of materials. Examples of suitable materials are ceramic- or graphite-based materials in the form of fibres or sintered powders. The capillary wick may have any suitable capillarity and porosity so as to be used with different liquid physical properties such as density, viscosity, surface tension and vapour pressure. The capillary properties of the wick, combined with the properties of the liquid, ensure that the wick is always wet in the heating area.

The aerosol-forming substrate may alternatively be any other sort of substrate, for example, a gas substrate, or any combination of the various types of substrate. During operation, the substrate may be completely contained within the electrically heated aerosol generating device. In that case, a user may puff on a mouthpiece of the electrically heated aerosol generating device. Alternatively, during operation, the substrate may be partially contained within the electrically heated aerosol generating device. In that case, the substrate may form part of a separate article and the user may puff directly on the separate article.

The device may include a flow sensor for detecting a flow rate of gas through the device. The sensor may be any sensor which can detect airflow, such as airflow indicative of a user inhaling. The sensor may be an electro-mechanical device. Alternatively, the sensor may be any of: a mechanical device, an optical device, an opto-mechanical device, a micro electro mechanical devices (MEMS) based sensor and an acoustic sensor. The sensor can be a thermal conductive flow sensor, a pressure sensor, an anemometer and should be able to not only detect an airflow but should be able to measure the airflow. So, the sensor should be able to deliver an analogue electrical signal or digital information that is representative of the amplitude of the air flow.

The electrically heated aerosol generating device may comprise an aerosol-forming chamber in which aerosol forms from a super saturated vapour, which aerosol is then carried into the mouth of a user. An air inlet, air outlet and the chamber are preferably arranged so as to define an airflow route from the air inlet to the air outlet via the aerosol-forming chamber, so as to convey the aerosol to the air outlet and into the mouth of a user.

Preferably, the aerosol generating device comprises a housing. Preferably, the housing is elongate. The structure of the housing, including the surface area available for condensation to form, will affect the aerosol properties and whether there is liquid leakage from the device. The housing may comprise a shell and a mouthpiece. In that case, all the components may be contained in either the shell or the mouthpiece. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle. The material of the housing may affect the amount of condensation forming on the housing which will, in turn, affect liquid leakage from the device Preferably, the aerosol generating device is portable. The aerosol generating device may be a smoking device and may have a size comparable to a conventional cigar or cigarette. The smoking device may have a total length between approximately 30 mm and approximately 150 mm. The smoking device may have an external diameter between approximately 5 mm and approximately 30 mm.

The method and electrically heated aerosol generating device according to the present invention provide the advantage that the temperature of the heating element is controlled, thereby providing a consistent and desirable experience for the user, without requiring any additional user or device actions.

According to another aspect of the invention, there is provided electric circuitry for an electrically operated aerosol generating system, the electric circuitry being arranged to perform the method of the other aspects of the invention.

Preferably, the electric circuitry is programmable to perform the method of the other aspects of the invention. Alternatively, the electric circuitry may be hardwired to perform the method of the other aspects of the invention.

According to another aspect of the invention, there is provided a computer program which, when run on programmable electric circuitry for an electrically operated aerosol generating system, causes the programmable electric circuitry to perform the method of the other aspects of the invention.

According another aspect of the invention, there is provided a computer readable storage medium having stored thereon a computer program according to the previous aspect of the invention.

Features described in relation to one aspect of the invention may be applicable to another aspect of the invention.

The invention will be further described, by way of example only, with reference to the accompanying drawings, in which.

Figure 1:
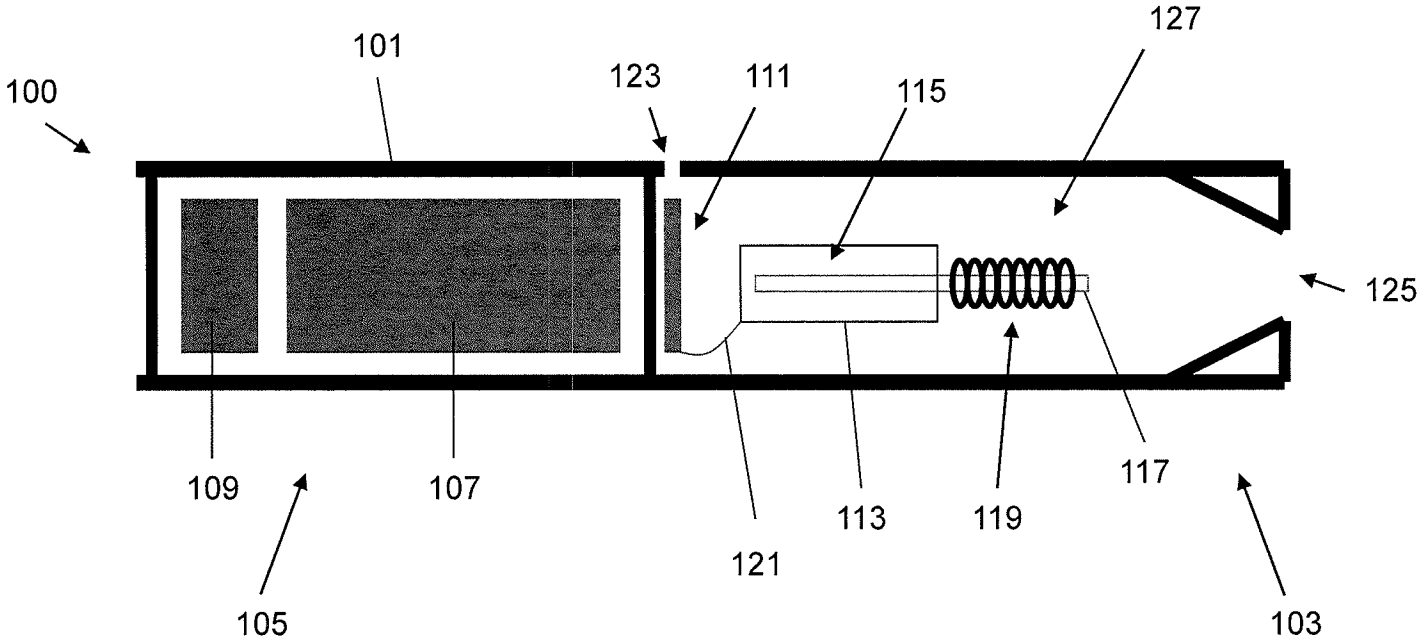
FIG. 1 shows one example of an electrically heated aerosol generating system in accordance with an embodiment of the invention.

FIG. 1 shows one example of an electrically heated aerosol generating system. In FIG. 1, the system is a smoking system having a liquid storage portion. The smoking system 100 of FIG. 1 comprises a housing 101 having a mouthpiece end 103 and a body end 105. In the body end, there is provided an electric power supply in the form of battery 107, electric circuitry in the form of hardware 109 and a puff detection system 111. In the mouthpiece end, there is provided a liquid storage portion in the form of cartridge 113 containing liquid 115, a capillary wick 117 and a heater 119 comprising at least one heating element. Note that the heating element is only shown schematically in FIG. 1. One end of the capillary wick 117 extends into the cartridge 113 and the other end of the capillary wick 117 is surrounded by the heating element 119. The heating element is connected to the electric circuitry via connections 121. The housing 101 also includes an air inlet 123, an air outlet 125 at the mouthpiece end and an aerosol-forming chamber 127.

In use, operation is as follows. Liquid 115 is transferred or conveyed by capillary action from the cartridge 113 from the end of the wick 117 which extends into the cartridge to the other end of the wick 117 which is surrounded by the heating element 119. When a user draws on the device at the air outlet 125, ambient air is drawn through air inlet 123. In the arrangement shown in FIG. 1, the puff detection system 111 senses the puff and activates the heating element 119. The battery 107 supplies energy to the heating element 119 to heat the end of the wick 117 surrounded by the heating element. The liquid in that end of the wick 117 is vaporized by the heating element 119 to create a supersaturated vapour. At the same time, the liquid being vaporized is replaced by further liquid moving along the wick 117 by capillary action. (This is sometimes referred to as "pumping action".) The supersaturated vapour created is mixed with and carried in the airflow from the air inlet 123. In the aerosol-forming chamber 127, the vapour condenses to form an inhalable aerosol, which is carried towards the outlet 125 and into the mouth of the user.

The capillary wick can be made from a variety of porous or capillary materials and preferably has a known, predefined capillarity. Examples include ceramic- or graphite-based materials in the form of fibres or sintered powders. Wicks of different porosities can be used to accommodate different liquid physical properties such as density, viscosity, surface tension and vapour pressure. The wick must be suitable so that the required amount of liquid can be delivered to the heating element. The wick and heating element must be suitable so that the required amount of aerosol can be conveyed to the user.

In the embodiment shown in FIG. 1, the hardware 109 and the puff detection system 111 are preferably programmable. The hardware 109 and puff detection system 111 can be used to manage the device operation. This assists with control of the particle size in the aerosol.

FIG. 1 shows one example of an electrically heated aerosol generating system which may be used with the present invention. Many other examples are usable with the invention, however. The electrically heated aerosol generating system simply needs to include or receive an aerosol forming substrate which can be heated by at least one electric heating element, powered by a power supply under the control of electric circuitry. For example, the system need not be a smoking system. For example, the aerosol forming substrate may be a solid substrate, rather than a liquid substrate. Alternatively, the aerosol forming substrate may be another form of substrate such as a gas substrate. The heating element may take any appropriate form. The overall shape and size of the housing could be altered and the housing could comprise a separable shell and mouthpiece. Other variations are, of course, possible.

Figure 2:
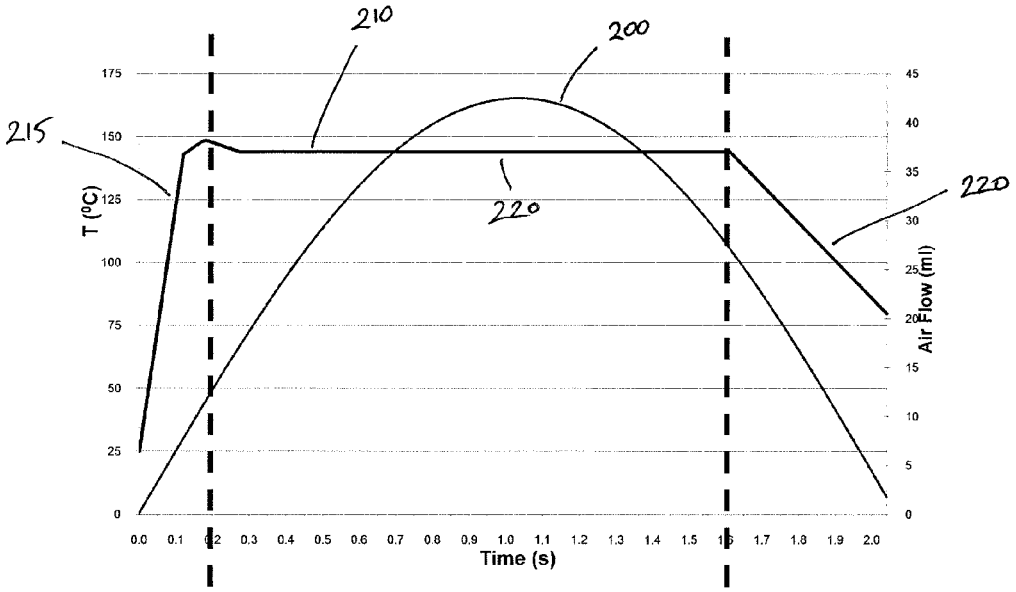
FIG. 2 illustrates a typical heating element temperature profile and a typical flow rate profile in a system of the type shown in FIG. 1.

As already mentioned, preferably, the electric circuitry, comprising hardware 109 and the puff detection system 111, is programmable in order to control the supply of power to the heating element. This, in turn, controls the temperature profile which affects the amount and the density of the aerosol produced. The term "temperature profile" refers to a graphic representation of the temperature of the heating element (or another similar measure, for example, the heat generated by the heating element) over the time taken for a puff, as shown in FIG. 2. Alternatively, the hardware 109 and the puff detection system 111 may be hardwired to control the supply of power to the heating element. Again, this controls the temperature profile which affects the amount and density of the aerosol generated.

The line 200 in FIG. 2 is a plot of the flow rate of air through the system during the course of a user puff. The puff lasts around 2 seconds and the flow rate rises from zero to a maximum flow rate at around 1 second, before dropping back to zero again. This is a typical puff profile but it should be clear that there can be great variation from puff to puff and from user to user both in the maximum flow rate and in the evolution of the flow rate during a puff.

The line 210 in Figure is the temperature of the heating element during the user puff. The temperature profile 210 is divided into three stages: an initial stage 215, during which maximum power is applied to the heating element in order to rapidly raise its temperature; a regulated stage 215, during which the temperature of the heating element is held constant (or at least within an acceptable temperature band), and an end of puff stage 220, during which power to the heater is cut or reduced.

Figure 3:
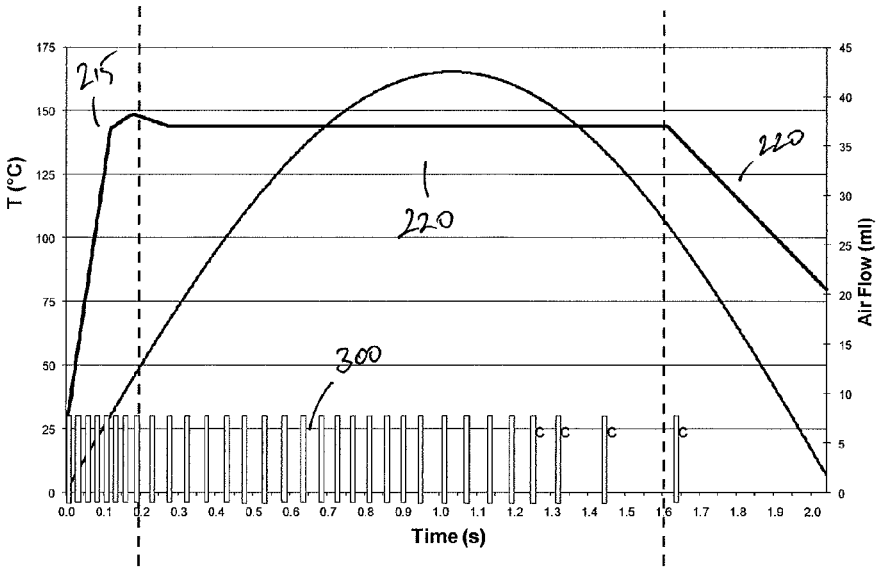
FIG. 3 illustrates a method of adjusting the power supplied to the heating element during the puff illustrated in FIG. 2.

FIG. 3 illustrates the power applied to the heating element during the user puff shown in FIG. 2. Power is supplied to the heating element in the form of a pulsed signal 300. In order to regulate the temperature of the heating element, the pulsed signal is modulated. As shown in FIG. 3, the average power that is applied to the heating element can be varied by changing the frequency (or "PFM"—pulse frequency modulation) of the modulations of the power signal at fixed duty cycle to keep constant the temperature of the heating element.

The other way of altering the power applied is PWM (pulse width modulation), which consists of varying the duty cycle at constant frequency. The duty cycle is the ratio of the time that the power is switched on to the time the power is switched off. In other words, the ratio of the width of the voltage pulses to the time between the voltage pulses. A low duty cycle of 5% will provide much less power than a duty cycle of 95%.

As shown in FIG. 3, during the initial stage 215, the power pulses 300 are delivered at high frequency in order to reach the desired temperature quickly. When the desired temperature is reached the regulated stage 220 begins. There is a small local maximum just as the regulated stage begins. This is due to the nature of the PID control scheme used to regulate the temperature. There is a small delay between sensing that the desired temperature has been reached and modulation of the power signal, which gives rise to the local maximum.

The desired temperature is dynamically calculated depending on the flow rate of gas past the heating element. For lower flow rates it is desirable to have a lower temperature. For example, the desired temperature may be set based on flow rate measured at a fixed time after activation of the heating element, may be based on an average flow rate calculated over previous heating cycles, or may be based on a cumulative flow rate over a fixed period after activation of the heating element.

In the regulated phase 220 the power pulses are delivered to the heating element just frequently enough to maintain the desired temperature. This means that the pulses are delivered at a lower frequency that during the initial stage. However, as the air flow rate continues to rise towards its maximum the cooling effect of the air also increases. This means that the frequency of the power pulses increases until the maximum flow rate is reached, before decreasing again as flow rate drops.

In the end of puff stage 220 the power is cut completely. A decision is taken to cut power before the end of the puff in order to ensure that all of the generated aerosol is flushed out of the system by the last portion of the puff. The temperature thus falls during this period as does aerosol production. The point at which power is cut or reduced, starting the end of puff stage, can be based, for example, on a simple time from activation, on a sensed flow rate or on a more sophisticated calculation that takes into account the puff profile.

Figure 4:
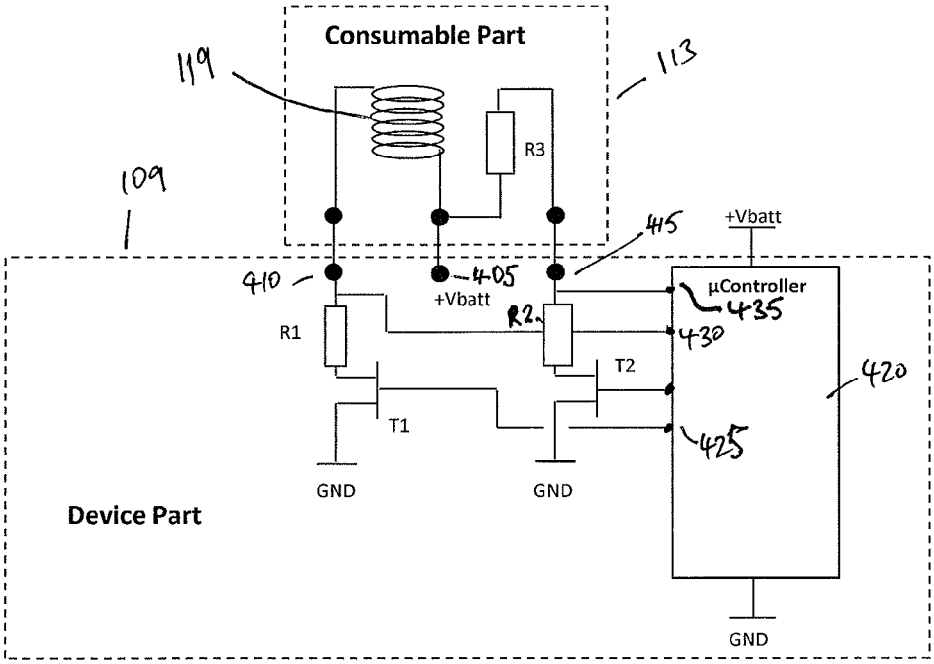
FIG. 4 illustrates electric circuitry for controlling the temperature of the heating element in accordance with the first embodiment of the invention.

FIG. 4 illustrates the control circuitry used to provide the described temperature regulation in accordance with one embodiment of the invention. The system has two parts: a consumable cartridge 113 containing liquid substrate 115, a capillary wick 117 and a heater 119; and a device part containing, a battery and electric circuitry 109, as described with reference to FIG. 1. In FIG. 3 only the electric circuit elements are illustrated.

The electrical power is delivered to the heating element 119 from the battery connection 405, through the measurement resistance R1 and the transistor T1. The frequency modulation of the PWM power signal is controlled by the microcontroller 420 and delivered via its analog output 425 to the transistor T1 which acts as a simple switch.

The regulation is based on a PID regulator that is part of the software integrated in the microcontroller 420. The temperature (or an indication of the temperature) of the heating element is determined by measuring the electrical resistance of the heating element.

The analog input 430 on the microcontroller 420 is used to collect the voltage across the resistance R1 and provides the image of the electrical current flowing in the heating element. The battery voltage V+ and the voltage across R1 are used to calculate the heating element resistance variation and or its temperature, as described with reference to FIG. 5.

The resistance R3 in the consumable part is used to identify the substrate composition. The resistances R3 and R2 are a simple voltage divider from which the voltage level is collected by the microcontroller 420 via its analog input 435 by activating transistor T2. The voltage converted will then be proportional to the resistance R3. A look-up table of resistance values for R3 and corresponding temperature ranges or resistance ranges for the heating element is located in an address memory in the microcontroller and is used to set the PID regulator and the temperature level at which the heating element will operate.

Figure 5:
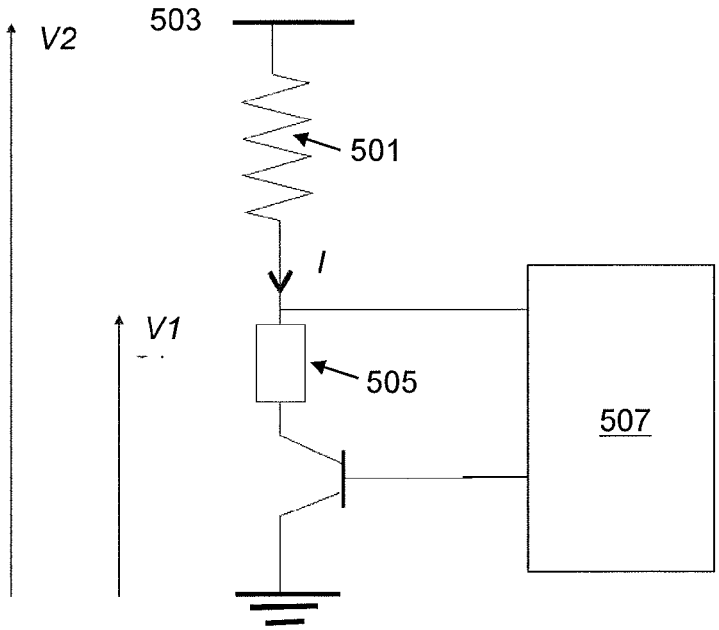
FIG. 5 illustrates a technique for determining the temperature of an electrical heating element by measuring electrical resistance.

FIG. 5 is a schematic electric circuit diagram showing how the heating element resistance may be measured in the system of the type shown in FIG. 4. In FIG. 5, the heater 501 is connected to a battery 503 which provides a voltage V2. The heater resistance to be measured at a particular temperature is $R_{heater}$. In series with the heater 501, an additional resistor 505, corresponding to R1 in FIG. 4, with known resistance r is inserted connected to voltage V1, intermediate between ground and voltage V2. In order for microprocessor 507 to measure the resistance $R_{heater}$ of the heater 501, the current through the heater 501 and the voltage across the heater 501 can both be determined. Then, the following well-known formula can be used to determine the resistance:

$$V=IR \tag{1}$$

In FIG. 5, the voltage across the heater is V2-V1 and the current through the heater is I. Thus:

$$R_{heater} = \frac{V2 - V1}{I} \tag{2}$$

The additional resistor 505, whose resistance r is known, is used to determine the current I, again using (1) above. The current through the resistor 505 is I and the voltage across the resistor 505 is V1. Thus:

$$I = \frac{V1}{r} \tag{3}$$

So, combining (2) and (3) gives:

$$R_{heater} = \frac{(V2 - V1)}{V1} r \tag{4}$$

Thus, the microprocessor 507 can measure V2 and V1, as the aerosol generating system is being used and, knowing the value of r, can determine the heater's resistance at a particular temperature, $R_{heater}$.

The following formula can be used to relate the temperature T to the measured resistance $R_{heater}$ at temperature T:

$$T = \frac{R_{heater}}{AR_0} + T_0 - \frac{1}{A} \tag{5}$$

where A is the thermal resistivity coefficient of the heating element material and $R_0$ is the resistance of the heating element at room temperature $T_0$.

An advantage of this embodiment is that no temperature sensor, which can be bulky and expensive, is required. Also the resistance value can be used directly by the PID regulator instead of temperature. If the resistance value is held within a desired range, so too will the temperature of the heating element. Accordingly the actual temperature of the heating element need not be calculated. However, it is possible to use a separate temperature sensor and connect that to the microcontroller to provide the necessary temperature information.

Although the embodiment described comprises a consumable part and a device part, the invention is applicable to other constructions of aerosol-generating device. It should also be clear that the temperature or resistance of the heating element need not be directly measured. For example, the temperature of the heating element may be estimated based on other measured parameters, such as a flow rate through the system, or may be estimated from a measure of air temperature at a point within the system.

The invention claimed is:

1. A method of controlling aerosol production in an electrically heated device, the device comprising:

a heater comprising at least one heating element; and a power source for providing power to the at least one heating element, the method comprising the steps of:

determining a temperature of the at least one heating element; and adjusting the power to the at least one heating element to maintain the temperature of the at least one heating element within a desired temperature range, wherein the desired temperature range is dynamically calculated based on a measured flow rate of gas through or past the device.

2. The method according to claim 1, wherein the desired temperature range is dependent on a composition of an aerosol-forming substrate received in the device.

3. The method according to claim 1, further comprising providing an initial power to the at least one heating element, wherein the step of adjusting the power to the t least one heating element is performed only when the heating element has reached a specific temperature within the desired temperature range.

4. The method according to claim 1, wherein the step of adjusting the power is performed only after specific time has elapsed following detection of a flow of gas through the device exceeding a predetermined threshold flow rate.

5. The method according to claim 1, further comprising the step of cutting or reducing power to the heating element based on a calculated parameter related to flow rate following the step of adjusting.

6. The method according to claim 1 wherein the step of adjusting the power to the heating element comprises adjusting a frequency or a pulse width modulation of a pulsed power signal.

7. The method according to claim 1, wherein the desired temperature range consists of a single desired temperature.

* * * * *